US005885330A

United States Patent [19]

Lee

[11] Patent Number: 5,885,330

[45] Date of Patent: Mar. 23, 1999

[54] SEPARATION SYSTEM AND METHOD OF UNBURNED CARBON IN FLYASH FROM A COAL-FIRED POWER PLANT

[76] Inventor: Jae Keun Lee, Guse-2 Dong 1011, Sunkyung Apt. 311-704, Gumjung-ku Pusan, Rep. of Korea

[21] Appl. No.: 888,587

[22] Filed: Jul. 7, 1997

[30] Foreign Application Priority Data

Aug. 12, 1996 [KR] Rep. of Korea ..... 96-33868

[51] Int. Cl.[6] ..... B03C 3/01

[52] U.S. Cl. ..... 95/69; 95/76; 95/78; 96/17; 96/32; 96/57; 96/61; 209/3; 209/127.1; 209/127.4

[58] Field of Search ..... 95/63, 69, 76, 95/78; 96/17, 57, 32–38, 55, 61; 209/2, 3, 11, 127.1–127.4

[56] References Cited

U.S. PATENT DOCUMENTS 3,029,577 4/1962 Hedberg ..... 209/127.1 X
3,493,109 2/1970 Carta et al. ..... 209/127.1 X
3,623,295 11/1971 Shriner ..... 96/17
4,052,983 10/1977 Bovender ..... 96/17 X
4,557,827 12/1985 Fricke et al. ..... 209/127.4
4,895,642 1/1990 Frei ..... 209/127.3
5,299,692 4/1994 Nelson et al. ..... 209/3 X
5,336,299 8/1994 Savell ..... 96/17 X
5,513,755 5/1996 Heavilon et al. ..... 209/11 X
5,681,374 10/1997 Von Glehn ..... 96/17 X

*Primary Examiner*—Richard L. Chiesa

[57] ABSTRACT

An apparatus and method for reducing the amount of unburned carbon in raw flyash, wherein raw flyash containing unburned carbon is introduced into the tribocharger, the tribocharger producing positive and negative surface charges on the respective particles of carbon and flyash, introducing the charged particles into an electrical field containing positively and negatively charged plates, the positively and negatively charged particles being collected on the negatively and positively charged plates, and selectively vibrating the plates to selectively recover the unburned carbon and flyash.

16 Claims, 2 Drawing Sheets

SEPARATION SYSTEM AND METHOD OF UNBURNED CARBON IN FLYASH FROM A COAL-FIRED POWER PLANT

BACKGROUND OF THE INVENTION

1. Field of the Invention

The present invention relates to a method and apparatus for separating unburned carbon from raw flyash generated from a coal-fired power plant. More particularly, the present invention is directed to a two-stage system which utilizes a centrifugal classifier and a triboelectrostatic separator for separating unburned carbon from raw flyash. The flyash can be used as an additive for concrete, as a stabilizer and filler in civil engineering applications, as an additive to soil, e.g. as a fertilizer, artificial zeolite, and the like.

2. Description of the Related Art

Various types of centrifugal classifier systems and methods for separating unburned carbon from raw flyash are known in the art. Generally, the amount of flyash generated from coal-fired power plants will be increasing in proportion to increases in coal-fired power plant construction. As an example, the amount of raw flyash generated from coal-fired power plants in South Korea in 1990 was about 3 million tons.

Most raw flyash generated from coal-fired power plants has generally been considered a waste product and thus has been used primarily to reclaim land from the sea. However, the reclaimed land has created environmental pollution problems, environmental plant destruction problems, and other related problems.

Recently, recycled flyash produced from raw flyash by centrifugal classifier systems have been used. However, in these systems, unburned carbon is destroyed and forms a contaminant in the ash thus produced. Unfortunately, unburned carbon in the ash absorbs some of the other additives and reduces the concrete strength if the flyash is used as a concrete filler. In this situation, the flyash contains over 7% of unburned carbon. Usually, flyash containing less than 3% of unburned carbon is a valuable flyash.

SUMMARY OF THE INVENTION

Accordingly, it is an object of the present invention to provide a method and apparatus for separating unburned carbon found in raw flyash gemerated from a coal-fired power plant, which eliminates the above problems encountered with conventional centrifugal classifier systems. Thus, by reducing the amount of unburned carbon in flyash below a certain level, e.g. below 3%, undesirable flyash becomes a desired product with a variety of uses.

Another object of the present invention is to provide an improved method and apparatus for separating unburned carbon from raw flyash to produce flyash containing less than 3% of unburned carbon so that the flyash can be recycled for use with many products. By recovering flyash which is a useful product, avoids the environmental pollution problem created when it is merely dumped.

A further object of the present invention is to provide a two-stage method and apparatus for treating flyash comprising the use of a centrifugal classifier and a triboelectrostatic separator for separating unburned carbon from raw flyash, which enables the flyash to be used as an additive for concrete. As a combined stabilizer and filler in civil engineering applications, as an improving agent for soil, e.g. as a fertilizer, as an artificial zeolite and the like.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a method and apparatus for separating unburned carbon from raw flyash generated from a coal-fired power plant, which includes a centrifugal classifier stage and a triboelectrostatic separator stage containing a tribocharger, a hopper, a pair of high voltage plates, and a pair of rapping devices.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
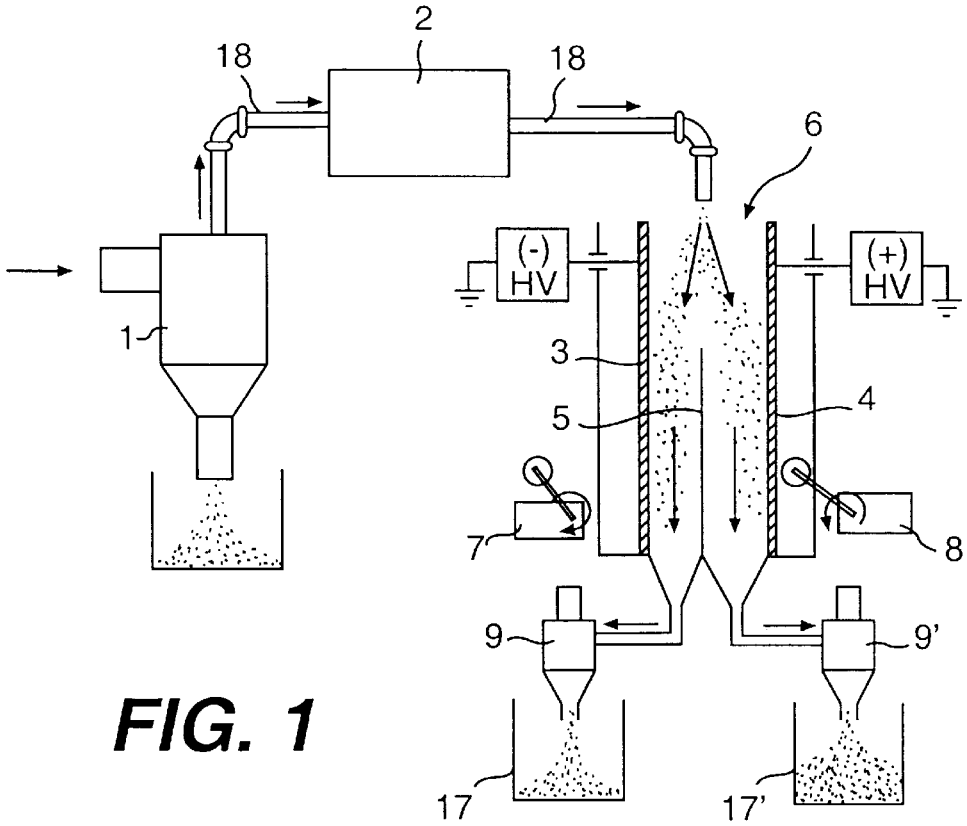
FIG. 1 is a diagrammatic view of the separation system according to the present invention.

Referring now in detail to the drawings for the purpose of illustrating the preferred embodiments of the present invention, FIG. 1 shows a method and apparatus for separating unburned carbon from flyash which is generated from a coal-fired power plant. The apparatus includes a centrifugal classifier 1 for removing large particles of unburned carbon from raw flyash, a tribocharger 2 made of copper for triboelectrostatically processing flyash treated in the centrifugal classifier 1, and a separator 6 containing electrical parallel copper plates 3 and 4 and a splitter 5 disposed between the plates for electrostatically separating unburned carbon from flyash. The copper plates 3 and 4 have a high voltage and are disposed at both sides of the separator 6. The large particles have a diameter larger than 125 $\mu$m.

The separator 6 is provided with a pair of rapping devices 7 and 8 disposed at the lower left and right sides of the hopper for alternately rapping the plates 3 and 4 to separately recover the flyash collected on the right plate 4 and the unburned carbon on collected on the left plate 3. The splitter 5 has a structure whereby the height can be adjusted as well as its lateral position within the separator 6. The separator 6 is provided with a pair of cyclones 9 and 9' for recovering the flyash in containers 17 and 17', respectively.

Figure 2A:
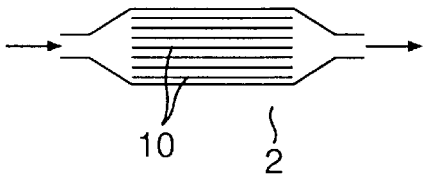
FIG. 2(A) is a diagrammatic view of a honeycomb-type tribocharger used in the separation system according to the present invention.

As can be seen by referring to FIGS. 2(A), 2(B), 2(C), 2(D), and 2(E), the tribocharger 2 has various types of structures for improving the efficiency of the triboelectrostatic separation of flyash from unburned carbon. As shown in FIG. 2(A), the tribocharger 2 has a honeycomb-shaped configuration which utilizes a plurality of step splitters 10.

Figure 2B:
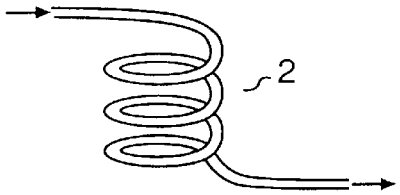
FIG. 2(B) is a diagrammatic view of a tube-type tribocharger used in the separation system according to the present invention.
Figure 2C:
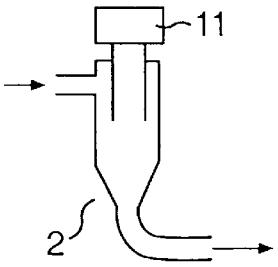
FIG. 2(C) is a diagrammatic view of a cyclone-type tribocharger used in the separation system according to the present invention.
Figure 2D:
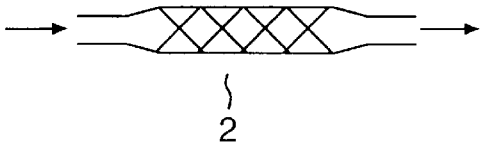
FIG. 2(D) is a diagrammatic view of a motionless mixer-type tribocharger used in the separation system according to the present invention.
Figure 2E:
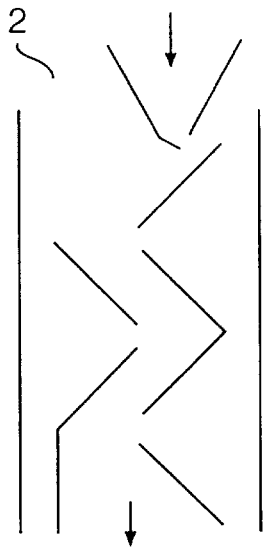
FIG. 2(E) is a diagrammatic view of a step-type tribocharger used in the separation system according to the present invention.

As shown in FIG. 2(B), the tribocharger 2 has a tube-shaped cross section which has a spiral screw configuration. As shown in FIG. 2(C), the tribocharger 2 has a cyclone-shaped configuration which contains a back filter 11. Referring to FIG. 2(D), the tribocharger 2 has a motionless mixer configuration which contains an electrostatic plate in a zigzag configured structure disposed within a tube. As shown in FIG. 2(E), the tribocharger 2 has a cascade configuration which utilizes a plurality of plates in a step configured structure disposed within the tube.

Figure 3:
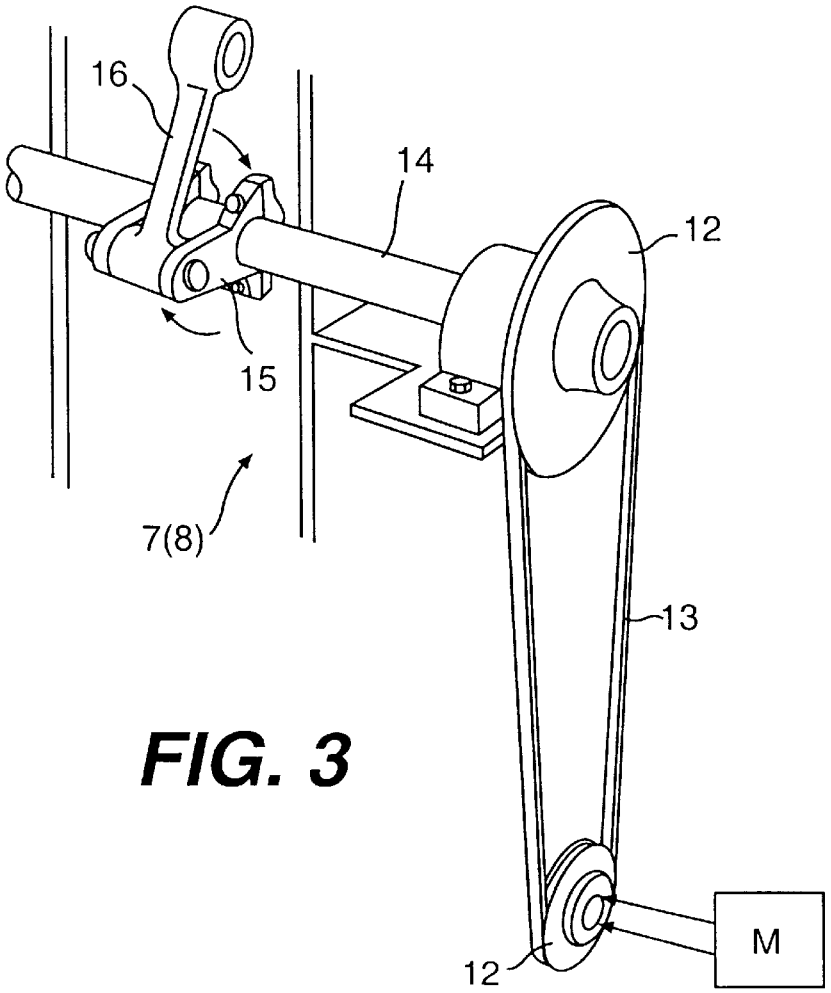
FIG. 3 is a perspective view of a rapping device used in the separation system according to the present invention.

Referring to FIG. 3, each rapping device 7 or 8 includes a first belt pulley 12 driven by a motor M, a second belt pulley 12 connected to the first belt pulley 12 through a belt 13, a driven shaft connected to the second belt pulley 12', an arm 15 attached to the driven shaft 14, and a rapper 16 attached to the arm 15 for alternately rapping the high voltage plates 3 and 4.

The system for separating unburned carbon in raw flyash from a coal-fired power plant according to the present invention operates as follows. When the raw flyash from a coal-fired power plant is passed through the centrifugal classifier 1, the resulting flyash contains approximately 5% carbon. The flyash is then passed through a delivery tube 18 to the tribocharger 2. At this time, the tribocharger 2 can be selected from the various structural types as shown in FIGS. 2(A) to 2(E). In the copper tribocharger the particles of unburned carbon and flyash are given respective positive (+) and negative (−) surface charges due to the differences in the work function values of the particles and coper surface which rub against each other in the tribocharger. In this triboelectrostatic process, the unburned carbon is separated from the flyash. Thus, the unburned carbon having a positive (+) surface charge and the valuable flyash having a negative (−) surface charge are conveyed into the separator 6 having an external electric field of 200 Kv/m. The positive (+) charged unburned carbon collects at the negatively (−) charged plate 3 and the negatively (−) charged flyash collects at the positive (+) charged plate 4.

The rapping devices 7 and 8 periodically and alternately strike the plates 3 and 4 whereby the unburned carbon is recovered in the recovering container 17 after treatment in the cyclone 9, and the valuable flyash is recovered in the recovering container 17' after treatment in the cyclone 9'. At this time, the valuable flyash shows a carbon content of less than 3%.

Accordingly, the method and apparatus of the present invention can effectively separate valuable flyash having less than 3% of carbon from raw flyash generated from a coal-fired power plant by utilizing a centrifugal classifier and a triboelectrostatic separator to treat waste products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for reducing the amount of unburned carbon in raw flyash which comprises:

a tribocharger, a centrifugal classifier disposed upstream of the tribocharger for removing larger particles of unburned carbon from the raw flyash, means for introducing said raw flyash containing unburned carbon into the tribocharger, said tribocharger producing positive and negative surface charges on the respective particles of carbon and flyash, means for introducing said charged particles into an electrical field containing positively and negatively charged plates, said positively and negatively charged particles being collected on the negatively and positively charged plates, respectively, and means for selectively vibrating said plates to selectively recover the unburned carbon and flyash.

2. The apparatus of claim 1, wherein the positively and negatively charged plates are disposed on opposite sides of a container and a position-adjustable splitter is provided in the container whereby the positively charged plate containing the negative particles is separated from the negatively charged plate containing the positive particles.

3. The apparatus of claim 2, wherein the container is provided with separated discharge means, each discharge means being positioned on opposite sides of the splitter.

4. The apparatus of claim 3, wherein each of the discharge means is provided with a separator.

5. The apparatus of claim 4, wherein the separator is a cyclone separator.

6. The apparatus of claim 1, wherein the means for vibrating the plates comprises a rapping means for striking the plates and motor means for driving the rapping means.

7. The apparatus of claim 1, wherein the tribocharger is a honeycomb tribocharger.

8. The apparatus of claim 1, wherein the tribocharger is a tube tribocharger.

9. The apparatus of claim 1, wherein the tribocharger is a cyclone tribocharger.

10. The apparatus of claim 1, wherein the tribocharger is a motionless mixer tribocharger.

11. The apparatus of claim 1, wherein the tribocharger is a cascade tribocharger.

12. A method of reducing the amount of unburned carbon in raw flyash which comprises introducing the raw flyash into a centrifugal classifier to remove large particles of unburned carbon therefrom, then introducing said raw flyash containing unburned carbon into a tribocharger, producing positive and negative surface charges on the particles of carbon and flyash;

introducing said charged particles into an electric field containing positively and negatively charged plates and separating said positively and negatively charged particles triboelectrostatically and collecting them on the negatively and positively charged plates, vibrating said plates to free said charged particles, and separately collecting said particles to recover unburned carbon and substantially carbon-free flyash.

13. The method of claim 12, wherein the substantially carbon-free flyash is flyash containing less than 3% carbon by weight.

14. The method of claim 12, wherein the raw flyash contains about 7% unburned carbon.

15. The method of claim 12, wherein the plates are held at a voltage of 200 Kv/m.

16. The method of claim 12, wherein the large particles have a size of greater than 125 $\mu$m.

* * * * *